US009132303B2

(12) United States Patent
Stuhlbacher et al.

(10) Patent No.: US 9,132,303 B2
(45) Date of Patent: Sep. 15, 2015

(54) FIRE-RETARDING DEVICE ON STORAGE TANKS

(75) Inventors: Franz Stuhlbacher, Graz (AT); Markus Kraiczar, Voitsberg (AT)

(73) Assignee: VSAT Satellitenkommunikation GmbH, Arrach (DE)

( * ) Notice: Subject to any disclaimer, the term of this patent is extended or adjusted under 35 U.S.C. 154(b) by 2651 days.

(21) Appl. No.: 11/569,669

(22) PCT Filed: May 19, 2005

(86) PCT No.: PCT/AT2005/000169

§ 371 (c)(1),
(2), (4) Date: Jan. 29, 2009

(87) PCT Pub. No.: WO2005/115551

PCT Pub. Date: Dec. 8, 2005

(65) Prior Publication Data

US 2011/0127052 A1 Jun. 2, 2011

(30) Foreign Application Priority Data

May 28, 2004 (AT) ..... A 932/2004

(51) Int. Cl.
*A62C 2/06* (2006.01)
*A62C 2/10* (2006.01)
(Continued)

(52) U.S. Cl.
CPC ... *A62C 3/06* (2013.01); *A62C 2/06* (2013.01); *A62C 2/065* (2013.01); *A62C 2/10* (2013.01); *A62C 3/002* (2013.01)

(58) Field of Classification Search
CPC ..... A62C 2/06; A62C 2/065; A62C 2/10; A62C 3/002
USPC ..... 169/48, 49, 54, 56, 58, 66, 68, 69
See application file for complete search history.

(56) References Cited

U.S. PATENT DOCUMENTS

| | | | | |
|---|---|---|---|---|
| 1,404,924 | A | 1/1922 | Bloss | |
| 3,049,261 | A * | 8/1962 | Wade et al. | 220/216 |
| 3,240,381 | A * | 3/1966 | Smith | 220/216 |

(Continued)

FOREIGN PATENT DOCUMENTS

| | | |
|---|---|---|
| DE | 19703308 | 8/1998 |
| GB | 1177538 | 1/1970 |

(Continued)

OTHER PUBLICATIONS

English language abstract of DE 197 03 308 A1; published Aug. 13, 1998.

*Primary Examiner* — Ryan Reis
(74) *Attorney, Agent, or Firm* — Greenblum & Bernstein, P.L.C.

(57) ABSTRACT

Device for reducing the risk of fire or delaying the ignition of flames in preferably large open or roofed storage tanks for combustible liquid media covered by floats, such as crude oil or the like, comprising a fixed cylindrical cavity as a tank for receiving the liquid, which tank is provided with a further protective barrier surrounding it at a certain distance and serving as a collecting chamber in case of leakage. The device is characterized in that the tank, if applicable the collecting chamber, contains floating cover bodies made of rolled-up stretched material that rest in a fined-up manner floating on the surface of the liquid, whereby polyurethane foam is inserted into the interior of the cover bodies, serving as a floating agent.

20 Claims, 2 Drawing Sheets

(51) Int. Cl.
*A62C 3/00* (2006.01)
*A62C 3/06* (2006.01)

(56) References Cited

U.S. PATENT DOCUMENTS 3,462,040 A * 8/1969 Galloway ..... 220/218
3,687,329 A * 8/1972 Baum ..... 220/216
3,910,452 A * 10/1975 Szasz ..... 220/226
4,213,280 A * 7/1980 Sandborn ..... 52/309.9
4,249,669 A * 2/1981 Szego ..... 220/216
5,377,765 A 1/1995 Kaylor
5,794,707 A * 8/1998 Alhamad ..... 169/69
7,225,942 B2 * 6/2007 Song ..... 220/218
2004/0016340 A1 1/2004 Heo

FOREIGN PATENT DOCUMENTS

GB 1454493 11/1976
GB 2028129 3/1980

* cited by examiner

Fig.1
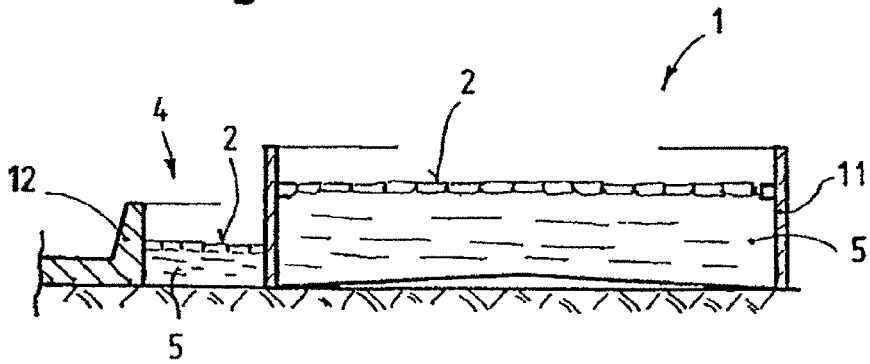
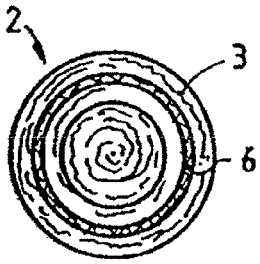
Fig.2
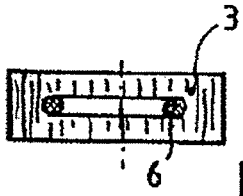
Fig.3
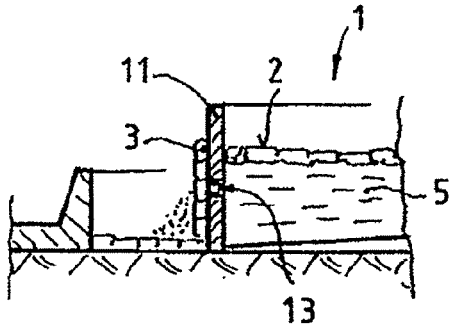
Fig.7
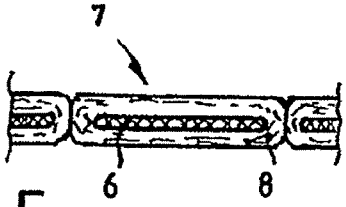
Fig.5
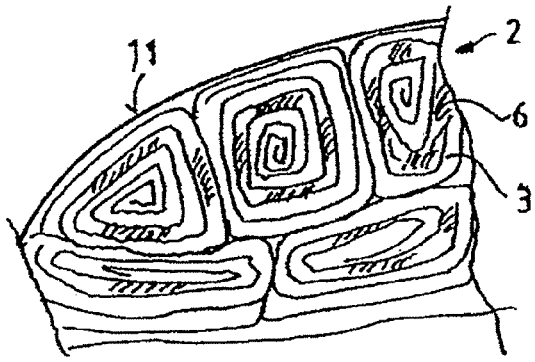
Fig.4
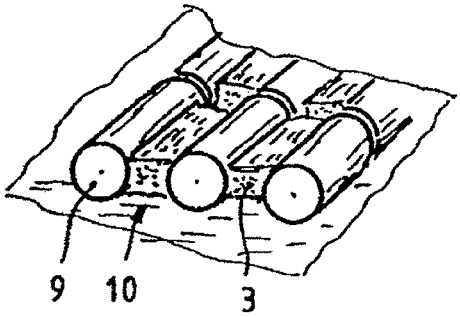
Fig. 6

FIRE-RETARDING DEVICE ON STORAGE TANKS

BACKGROUND OF THE INVENTION

1. Field of the Invention

The invention relates to a device for reducing the risk of fire or delaying the ignition of flames in preferably large open or roofed storage tanks for combustible liquid media covered by floats, such as crude oil or the like, comprising a fixed cylindrical cavity as a tank for receiving the liquid, which tank is optionally provided with a further protective barrier surrounding it at a certain distance and serving as a collecting chamber in case of leakage.

2. Background Information

In case of afire, this device serves to delay the spreading until countermeasures can be taken or it is possible to make fire-fighting provisions. This is of particular importance, since valuable time passes before the discovery of a fire and the arrival of fire fighting vehicles.

It is known to discover or reduce a spreading of the fire through alarm devices and local fire protection devices, but this is not sufficient to delay the ignition of flames in large tanks. Provisions are made such as solid covers for oxygen deprivation, containment of the development of heat and the like, but the almost explosive ignition of flames cannot be stopped in most cases, in particular if the filling level of roofed tanks sinks so far that the ambient air promotes the fire or the collecting chamber surrounding the tank starts to fill through leakage.

It is also known to provide floating bodies, e.g., lined-up floats such as barrels, in order to decelerate a forming surface fire. It is, however, disadvantageous that with the line-up, gaps form that cannot delay the igniting fire, and the remedy must be evaluated as modest.

U.S. Pat. No. 5,377,765 A describes a device of a similar type in which a roof is used as a cover body. Depending on the degree of filling, this can be shifted in an axial direction and is provided with sealant on the peripheral edge.

U.S. Pat. No. 3,462,040 A shows an arrangement whereby cover bodies rest in a lined-up manner floating on the surface of the liquid and are secured by means of a net-like mat spread over them.

DE 197 03 308 A1 describes a safety netting of stretched material that can among other things be used to cover combustible liquids. This stretched material formed of irregular fibers is, however, not suited to reduce the risk of a fire, since a homogeneous covering is not present on account of outside influences, e.g., wind or the like.

SUMMARY OF THE INVENTION

On the basis of this prior art, it was the object of the invention to create a device that delays an ignition of flames until countermeasures can be initiated at any filling level. According to the invention the object is attained in that the tank, if applicable the collecting chamber, contains cover bodies preferably made of rolled-up stretched material that rest in a lined-up manner floating on the surface of the liquid, whereby PU foam is inserted into the interior of the cover bodies, serving as a floating agent. This has the advantage that the otherwise rapid ignition of flames at the beginning of a fire is effectively delayed.

It is advantageous if the PU foam is applied in toroidal form in the interior of the cover bodies. The float thus always remains in a horizontal position.

It is also advantageous if the cover bodies are made of stretched material formed from a band and built of one or more layers as a roll and if these bodies are arranged in the tank in a closely lined-up manner, forming conforming shapes. This ensures that no or the fewest possible gaps remain between the individual floating cover bodies.

It is advantageous if an endless tube preferably woven from wire screen, or made of several connected tube parts or of a perforated band, is embodied as a cover body and is provided with spherical, cylindrical or cubic shapes formed of stretched material as filler, whereby PU foam is inserted on the inside of the tube as a floating agent. This is a further variant for building cover bodies that can additionally be used, e.g., on the edge zones of the tank.

It is also advantageous if the cover bodies contain as a floating agent, filled shapes in the form of hollow spheres, pipes or the like and are arranged, if applicable provided with PU foam. It is thereby possible to build floating agents built independently of stretched material, to achieve in a simple manner a cover that meets the requirements, if applicable in combination with the floating agents.

It is further advantageous if, depending on the cover bodies, these comprise lined-up barrel-shaped floats and the remaining gaps are filled with stretched material, formed as a roll, tube or the like, provided with PU foam if applicable. It is thus achieved that with existing devices the gaps are filled and a complete cover is achieved.

It is further advantageous if stretched material constructed in bonded form is attached to the side wall of the tank on the outside. If a leakage occurs caused, e.g., by bombardment, the liquid thus flows into the collecting chamber in a trickling manner and can flow more slowly directly below the cover bodies.

It is also advantageous if the cover bodies rest loosely on a cover roof leaving gaps, filling at least 70% to 80% of the surface of the cover roof. This also achieves an effective delay of the ignition of flames.

Finally it is advantageous with double shell tanks if the gap between the two side walls is filled completely with stretched material, if applicable only in the upper area. This provides a complete protection in this area, or at least inhibits ignition.

BRIEF DESCRIPTION OF THE DRAWINGS

The invention will be explained in further detail on the basis of an exemplary embodiment. The figures show:

FIG. 1 A tank in section with a collecting chamber

FIG. 2 Stretched material embodied as a roll

FIG. 3 Section through a roll with inserted PU foam

FIG. 4 Inserted roll of stretched material, lined-up firmly

FIG. 5 Variant of floating agents as a tube shape

FIG. 6 Use of stretched material with barrel-shaped floating agents

FIG. 7 Arrangement of stretched material on the side wall of the tank

DETAILED DESCRIPTION

Figure 8:
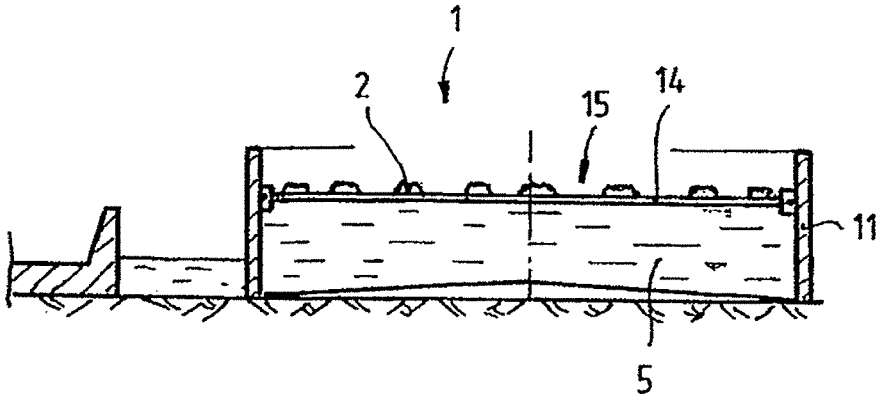
FIG. 8 Arrangement of cover bodies on a cover roof

FIG. 1 shows in section an installation for receiving combustible liquid media, such as crude oil or the like. The tank 1, which comprises a cylindrically arranged side wall 11 connected tightly to the floor in a fixed manner, is filled with crude oil 5. Floating covers, so-called cover bodies 2, are laid on the surface of the liquid 5, which cover bodies are connected to one another in a jointless manner. Outside the tank 1 a collecting chamber 4 is provided which serves to receive any leaked liquid 5 and is delimited by the ring barrier 12. The collecting chamber 4 is dimensioned such that it can receive the amount of liquid until level equalization.

FIG. 2 shows a cover body 2 comprising stretched material 3 with one or more layers. The stretched material 3 is built from a metal band which contains a plurality of small lengthwise, staggered cuts and forms bridges by lateral stretching. This stretched material 3 is now processed into a roll first of all. PU foam 6 is now inserted into the interior, which foam serves as a floating agent, since the stretched material 3 is composed of, e.g., aluminum and cannot float. This roll is not capable of floating until charged with PU foam 6, which is inserted in toroidal form into the interior of the roll.

FIG. 3 shows the positioning of the PU foam 6 in the interior of the roll of stretched material 3. It is essential that the positioning is uniform so that the stretched material 3 lies horizontally on the surface of the liquid 5.

FIG. 4 shows a part of the inserted cover body 2, whereby the stretched material 3 formed into a roll is stored lined up as jointlessly as possible through compression during the assembly. In addition to geometrical shapes, such as triangular, square or rectangular, the most varied shapes can thereby be assumed as required, in order to close otherwise emerging gaps.

FIG. 5 shows a further variant of cover body 7 which is composed of a perforated tube 8 or lined-up connected tube parts. This tube 8 is now filled with spherical, cylindrical or cubic shapes formed of stretched material 3, whereby PU foam 6 is attached to the interior wall of this tube 8. However, the tube 8 can also be composed of a woven wire screen which in turn contains the above-mentioned stretched material 3 with PU foam 6. Naturally such a tube 8 can also assume any shape as required in order to prevent undesired gaps.

FIG. 6 shows an existing covering by means of floating lined-up barrels 9 as a floating agent. The gaps 10 are hereby filled with stretched material 3. The cover body 2 is hereby embodied in a jointless manner and also contributes to retarding the formation of flames.

FIG. 7 finally provides a possible method of using stretched material 3. Stretched material 3 embodied in a roughly cuboid-shaped manner is now attached in bonded form to the side wall 11 of the tank 1 on the outside. This has the advantage that with leakage 13 caused for instance by a destructive influence such as bombardment, the leaking of the liquid 5 can be moderated. Now the liquid 5 does not flow into the collecting chamber 4 in a strong jet, but trickles slowly so that the cover bodies 2 stored here as well can slowly rise in a floating manner and form a protective layer.

FIG. 8 shows a possible covering method when a cover roof 14 exists and an effective covering is to be made subsequently. It is hereby sufficient if the cover bodies 2 rest loosely leaving gaps 15. At least 70% to 80% of the surface of the cover roof 14 is to be covered; as experiments revealed, an effective protection is also achieved here.

Figure 9:
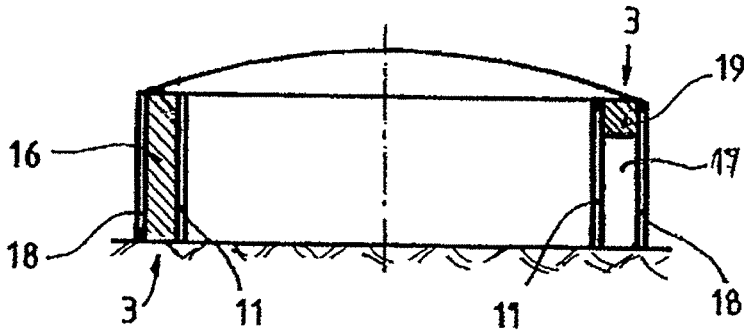
FIG. 9 Arrangement of cover bodies on double shell tanks

FIG. 9 shows an embodiment variant as can be used advantageously with double shell tanks. The gap 16, 17 between the two side walls 11, 18 is completely filled with stretched material 3. A complete protection is thus achieved, i.e., made mechanically inert, or stretched material 3 is attached at least in the upper area 19 in one or two layers, e.g., 15 to 50 cm thick.

It is essential that the risk of fire is reduced or the ignition of flames is delayed through the cover bodies 2 embodied in this manner, in order to make use of the time from the fire alarm to the activation of fire-fighting measures and to prevent severe damage. As experiments showed, fire and above all the development of smoke is delayed. A cost-effective use of stretched material that can be produced simply is provided in any case.

The invention claimed is:

1. Device for delaying ignition of flames and reducing burning temperature in open or roofed storage tanks for combustible liquid media comprising:

a fixed tank for receiving the liquid media, cover bodies made of rolled-up stretched material containing a plurality of cavities, arranged in a lined-up manner, and positioned and arranged for at least one of being carried by the liquid and being coupled to a roofing located over the liquid, and a floating agent is contained within the cover bodies.

2. The device according to claim 1, wherein the floating agent comprises polyurethane foam is arranged in toroidal form in the interior of the cover bodies.

3. The device according to claim 1, wherein the cover bodies are made of stretched material formed from a band and built of at least one layer as a roll and the cover bodies are arranged in the tank in a closely lined-up manner, forming conforming shapes.

4. The device according to claim 1, wherein an endless tube is embodied as a cover body and is provided with spherical, cylindrical or cubic shapes formed of stretched material as filler, and the floating agent comprises polyurethane foam inserted into the interior of the tube.

5. The device according to claim 1, wherein the cover bodies contain as a floating agent, filled shapes in the form of hollow spheres or pipes.

6. The device according to claim 1, wherein the cover bodies comprise lined-up barrel-shaped floats and gaps between the floats are filled with stretched material, formed as a roll or tube.

7. The device according to claim 1, wherein stretched material constructed in bonded form is attached to a side wall of the tank on the outside of the side wall.

8. The device according to claim 1, wherein cover bodies rest loosely on a cover roof leaving gaps, filling at least 70% to 80% of the surface of the cover roof.

9. The device according to claim 1, wherein the gap between the two side walls is filled completely with stretched material.

10. The device according to claim 1, wherein the liquid media comprises crude oil.

11. The device according to claim 1, wherein the tank includes a cylindrical cavity.

12. The device according to claim 1, further including a protective barrier surrounding the tank and forming a collecting chamber in case of leakage.

13. The device according to claim 12, further including cover bodies made of rolled-up stretched material containing a plurality of cavities, arranged in a lined-up manner in the collecting chamber, and a floating agent is contained within the cover bodies.

14. The device according to claim 12, wherein the floating agent comprises polyurethane foam.

15. The device according to claim 4, wherein the endless tube is woven from wire screen.

16. The device according to claim 4, wherein the endless tube comprises a plurality of connected tube parts.

17. The device according to claim 4, wherein the endless tube comprises a perforated band.

18. The device according to claim 5, wherein the hollow spheres or pipes include polyurethane foam.

19. The device according to claim 6, wherein the stretched material includes polyurethane foam.

20. The device according to claim 1, wherein the stretched material is formed from a metal band having a plurality of staggered, longitudinal cuts, such that stretching of the stretched material forms bridges.

* * * * *